US009175411B2

(12) United States Patent
Malusel et al.

(10) Patent No.: US 9,175,411 B2
(45) Date of Patent: Nov. 3, 2015

(54) GOLD AND SILVER EXTRACTION TECHNOLOGY

(75) Inventors: Viorel Alexandru Malusel, Judet Alba (RO); Ioan Florentin Popa, Bucaresti (RO); Jack Goldstein, Judet Maramures (RO); Liana Rozica Osanu, Judet Maramures (RO)

(73) Assignee: Viorel Alexandru Malusel, Alba Iulia, Judet Alba (RO)

( * ) Notice: Subject to any disclaimer, the term of this patent is extended or adjusted under 35 U.S.C. 154(b) by 0 days.

(21) Appl. No.: 14/003,835

(22) PCT Filed: Mar. 8, 2012

(86) PCT No.: PCT/RO2012/000005

§ 371 (c)(1),
(2), (4) Date: Sep. 9, 2013

(87) PCT Pub. No.: WO2012/141607

PCT Pub. Date: Oct. 18, 2012

(65) Prior Publication Data

US 2013/0341203 A1 Dec. 26, 2013

(30) Foreign Application Priority Data

Mar. 9, 2011 (RO) ..... A 11 0207

(51) Int. Cl.
*C25C 1/20* (2006.01)
*C22B 3/00* (2006.01)

(52) U.S. Cl.
CPC .. *C25C 1/20* (2013.01); *C22B 11/04* (2013.01)

(58) Field of Classification Search
CPC ..... C25C 1/20; C22B 11/04
USPC ..... 204/565, 568, 569, 571; 205/565, 568, 205/569, 571
See application file for complete search history.

(56) References Cited

U.S. PATENT DOCUMENTS

| | | | | |
|---|---|---|---|---|
| 3,728,235 | A * | 4/1973 | Cooley et al. | 205/566 |
| 3,944,414 | A * | 3/1976 | Yanagida et al. | 75/418 |
| 2004/0115108 | A1 * | 6/2004 | Hackl et al. | 423/22 |
| 2010/0111751 | A1 * | 5/2010 | Hackl et al. | 420/461 |

OTHER PUBLICATIONS

Abbruzzese et al., Thiosulphate leaching for gold hydrometallurgy, 1995, Hydrometallurgy 39 pp. 265-276.*

* cited by examiner

*Primary Examiner* — Arun S Phasge
(74) *Attorney, Agent, or Firm* — Lucas & Mercanti, LLP; Jonathan Myers

(57) ABSTRACT

The present invention relates to a process for chemical extraction of gold and silver from low grade and refractory pyritic concentrates containing minimum 1 ppm Au, by their leaching in enameled cast iron reactors, steel plated lead or plastic coated steel, at room temperature, in ammoniac solutions (pH 8-10) of sodium thiosulfate (50-60 g/l $Na_2S_2O_3$. 5 $H_2O$) with a divalent copper salt as catalyst (3-4 g/l Cu). The suspension resulting after 2-4 hours of reaction is filtered. The thiosulfate solution containing minimum 5 mg/l undergoes an electrolysis process with insoluble anodes. Copper, gold and silver is deposited in the cell as a sludge, and the electrolyte having a maximum content of Au of 1 mg/l, is recycled to the leaching operation of raw material, after correction of copper content and alkalinity to the baseline values. The copper, gold and silver deposit, separated as a sludge, is purified by leaching copper in a solution of 30-40% sulphuric acid at a solid:liquid ratio of 1:5-1:10, at a temperature of 85-90° C. for 2-4 hours under air bubbling. The suspension is filtered. The copper leached as $CuSO_4.5H_2O$ returns to the extraction process of gold and silver.

5 Claims, No Drawings

GOLD AND SILVER EXTRACTION TECHNOLOGY

CROSS REFERENCE TO RELATED APPLICATIONS

This application is the U.S.-national stage of PCT application PCT/RO2012/000005 filed 8 Mar. 2012 and claiming the priority of Romanian patent application a201100207 itself filed 9 Mar. 2011.

The present invention relates to a process for chemical extraction of gold and silver from ores, refractory pyritic concentrates, flotation tailings and metallurgical slag by using as reagent a sodium thiosulphate solution in the presence of ammoniac and of a bivalent copper salt as catalyst and their separation form the solution and the recycling the reagents used in the leaching process.

There are known methods for gold and silver extraction by leaching pyritic ores and concentrates in alkaline thiosulfate solutions by prior oxidation under oxygen pressure in basic or acid solutions, by biochemical reactions, oxidation reactions with chlorine or chlorates, by direct leaching in the presence of copper or nickel as activators. The separation of gold and silver from thiosulphate solutions is achieved by adsorption on ion exchangers, activate carbon, electrochemical processes, by cementation on copper, zinc or aluminum, by precipitation with alkaline sulphides. The extraction of pure metals is achieved by a reducing alkaline melting and electrochemical refining.

For example: in the Canadian patent 02412352/2002, the leaching of a Nevada ore type having 24.1 ppm Au (example 1) is performed in autoclaves with a suspension containing 25 g/l ammonium thiosulphate at a solid:liquid ratio of 1:3 and an oxygen pressure of 100 atm and a temperature of 20-60° C. The duration of the process is of 6 hours and the gold leaching efficiency is of 81%. Under the conditions of example 10, the gold ore with 2.48 ppm Au, coarse milled and placed in plastic columns, sprayed with an aerated solution containing 15 g/l ammonium thiosulphate at a spray rate of 12-130 l/h $m^2$ and a temperature of 22° C., a leaching efficiency of gold of 71% is achieved after 34 days.

In the Canadian patent 02209559/2001, the ore containing 6 ppm Au is oxidized in alkaline solution in autoclaves under an oxygen pressure at 210-225° C. The suspension obtained is alkalized to pH 9 with ammonia solution and extracted with a solution containing 14.7 g/l thiosulphate and 1 g/l copper. Gold and silver are leached with an efficiency of 80% and separated by cementation with zinc, copper or aluminum. The pure metals are extracted from the cement by conventional hydrometallurgical and pyrometallurgical processes.

In the U.S. patent 2003/0051581, gold leaching is done with a solution 0.1 m ammonium thiosulfate and 500 mg/l bivalent copper ions. The extraction of metals gold, silver and copper from the thiosulfate solution is achieved with ion exchange resin (IRA 93 or IRA 410), when gold concentrates to 9 kg/t resin.

In the patent WO 2007/053947 the leaching process of gold from pyrites takes place in two phases, that is: in the first phase the ore compounds are oxidized with oxygen in autoclaves at 100 atm in a suspension of diluted sulphuric acid. The oxidized ore, washed with water and regenerated with a 0.1 m solution of sodium sulphite at a solid:liquid ratio of 1:2.5, according to Example 5, after 4 hours of stirring at a temperature of 70° C. a solution of 7.39 g/l sodium thiosulphate is produced, which provides an efficiency of 81% of the gold leaching process.

In the patent WO 2007/098603, the leaching of ore having a content of 17 g/l gold is done with an ammonium thiosulfate solution containing 0.2 m CuSO4.5H2O 300 mg/l and $NH_4OH$ 0.9 m lasts 24 hours at an efficiency of 90.7%. The leached gold is retained on the resin DOWEX21K and the thiosulfate consumption is of 17.8 kg/t ore.

These methods have the following disadvantages:

in the first stage an oxidation process of pyritic ore or concentrates takes places at high temperatures and pressures in autoclaves in alkaline or acid solutions.

the thiosulphate solution used for extraction of gold and silver is not recycled in the process, that means that a residual solution is produced that requires further purification.

they provide a low concentration of gold in the final product.

they are energy-intensive technologies.

The thermal problem that the present invention aims to solve is the exploitation of low-grade materials having a content of minimum 1 ppm Au and the recirculation within the system of the reagents used in the leaching process of gold and silver and finally to extract these pure metals.

The solution of the above-mentioned technical problem consists in the treatment of raw materials containing a minimum of 1 ppm Au, under stirring, with a solution resulting from the operation of electrochemical separation of gold, silver and copper, containing: 50-60 g/l $Na_2S_2O_3$, 5:20, 0.1-0.2 g/l Cu, 5-7 g/l $(NH_4)SO_4$, 1 g/l $NH_3$, corrected to 3-4 g/l Cu and 3 g/l $NH_3$ (pH=10), at a solid:liquid ratio of 1:1-1:1.5 for 2-4 hours at a temperature of 15-25° C. After filtering the resulting suspension results a residue which, in the absence of common metals, can be used as filler in construction, or otherwise as a raw material for their recovery. The solution resulting from the leaching process, after prior recirculation to a minimum of 10 ppm Au+Ag, undergoes an electrochemical extraction with insoluble electrodes when settles a copper cement that has a content of 5.000-12.000 ppm Au and 25.000-80.000 ppm Ag.

The solution resulting after the alkaline electrolysis process with 1 ppm Au and 0.2 g/l Cu, is corrected to the baseline values and recycled in the leaching process of gold and silver.

The copper cement and the precious metals separated from the electrolysis cell, undergo a chemical refinery process with a hot (70-90° C.) acid leaching process in a sulphuric acid solution, bubbled with air, at a solid:liquid ratio of 1:5-1:10 for 2-4 hours.

By acid leaching, the copper contained in the cement goes into the solution with an efficiency of 80-90% resulting a solution of copper sulphate and gold and silver remain in the sludge which contains 5-7% Au and 12-15% Ag. The sludge is collected, filtered, washed with water and dried at 105° C. The processing method of this sludge in order to obtain Au—Ag alloy (dore alloy) is the classic alkaline melting and the refilling to pure metal is done by the electrochemical method and the result is gold and silver of 99.9% purity.

The reactions taking place in the process are:

Y2 O2 ½ $O^{2-}$+2e $Cu(NH_3)^{2+}$+2H2O+e Cu(NH3)$2^{+}$+2$NH_4OH$

Cu(NH3)$2^{+}$+2$S_2O_3{}^{2}$+2$H_2O$→Cu(S2O3)$2^{3-}$+2$NH_4OH$

Cu($S_2$O3)$2^{3}$+.Au→Au $(S_2O_3)_2{}^{3-}$+.Cu

Cu(S2O3)$2^{3-}$+.Ag Ag(S2$^{0}$3)$2^{3}$+.Cu

Au(S2O3)$2^{3}$"−.e→Au+(S2O3)$2^{2-}$

Ag(S2O3)$2^{3}$"−e Ag (S2O3)$2^{2-}$

Cu(S2O3)$2^{3}$"−e→Cu+(S2O3)$2^{2-}$

Cu—Au—Ag+$H_2SO_4$+½ O2−±Cu SO4 Au—Ag+$H_2O$

CuSO4+$NH_4OH$→$Cu(NH_3)^{2+}$+$SO_4{}^{2}$"+H2O

We give below two examples on the implementation of the invention:

EXAMPLE 1

In a reactor made of plastic or enameled cast iron with a capacity of 4 cubic meters, equipped with a stirring system are placed 3 cubic meters of a solution resulting from alkaline electrolysis, containing: 0.1-0.2 g/l Cu, 510 g/l (NH4)2SO4, 1.5-3.0 g/l $NH_4OH$, 50-60 g/l $Na_2S_2O_3$, 5:20. It is corrected to 3-4 g/l Cu, 50-60 g/$Na_2S_2O_3$.5H2O, 3 g/l $NH_4OH$ and 2500 kg siliceous ore containing 1.8 ppm Au and 18.6 ppm Ag. The suspension is stirred for 3 hours with by bubbling 5 cubic meter/h air and filtered on a rotary vacuum filter.

The resulting sludge (2500 kg) is washed with 0.2-0.3 cubic meter water and it results a siliceous residue without toxic impurities. The filtrate solution is adjusted with $NH_4OH$ to pH 9-10 and returned to the leaching process of the siliceous ore, up to a minimum content of 5 mg/l Au, and then it undergoes an electrolysis on high-alloyed steel anodes at a current density of 3-3.5 A/dm2.

The electrolysis process is considered as finished, when the gold concentration of the electrolyte does not exceed 1 mg/l (12-14 hours).

After a number of 5 cycles of electrolysis, the sludge containing copper, gold and silver, that drops from the cathode in the electrolytic cell undergoes a leaching process for copper in sulphuric acid. The operation is performed in a reactor with stirring and heating jacket, made of enameled cast iron or steel antacid protected with lead. The operation is performed at a temperature of 85-95° C. and a solid:liquid ratio of 1:5-1:10, using a sulphuric acid solution with a concentration of 30-40%, bubbled with air. The suspension resulting after 2-4 hours of reaction is filtered hot (50° C.). The resulted acid solution of copper sulphate having a content of 95-120 g/l Cu and 30-200 g/l $H_2SO_4$ is crystallized by cooling it when $CuSO_4.5H_2O$ is separated as a crystalline product. The copper sulphate resulted is used in the leaching process of the raw material in order to correct the copper content of the solution resulting after the electrochemical separation of the cement containing copper, gold, silver. The sludge resulting from filtering the suspension is filtered, washed with water and dried at 105° C. and it has a content of 6.2% Au and 13.5% Ag.

After drying, the sludge is mixed with sodium carbonate and active coal at a ratio of 1:3:0.5 and melted in a graphite crucible at a temperature of 11501200° C. The Au—Ag alloy (lore alloy) is cast as anodes and undergoes the conventional electrochemical and thermal refining operations in order to obtain pure gold and silver.

The global efficiency of operation ore-metal is of 78.2% for gold and of 76.1% for silver.

EXAMPLE 2

The operations ensue in the same way as in example 1 excepted that the raw material is a pyritic concentrate containing 10 ppm Au and 40 ppm Ag.

The global efficiency ore-pure metal is in this case of 82.2% for gold and of 81.5% for silver.

The gold and silver extraction method is not toxic, it does not generate wastewater or toxic gas emissions.

The method is applicable for obtaining gold and silver from refractory low-grade pyritic ores and concentrates in alkaline cyanide extraction, ensuring the recirculation of all reagents in the raw material leaching process.

The invention claimed is:

1. A method of extracting gold and silver from low-grade refractory ores and concentrates, the method comprising the steps of:

leaching gold and silver from the low-grade refractory ores and concentrates in sodium thiosulfate reagent solutions of 50-60 g/l $Na_2S_2O_3 \cdot 5H_2O$ and 5 to 10 g/l $(NH_4)_2SO_4$ alkalized with ammonium hydroxide at pH 8-10 with a bivalent copper salt of 3-4 g/l Cu as activator at ambient temperature while stirring for a time of 2-3 hours to obtain a thiosulfate solution containing gold and silver having a minimum content of 5 ppm Au; and electrolytically extracting gold and silver together with copper from the thiosulfate solution containing gold and silver having a minimum content of 5 ppm Au, to obtain a Cu—Au—Ag cement.

2. The method according to claim 1, wherein the electrolytic extraction of gold and silver together with copper from the thiosulfate solution having a minimum content of 5 ppm Au, is carried out by electrolysis in alkaline solution at a pH of 8 to 10 by using high-alloyed steel electrodes at a current density of 3.0-3.5 A/dm2, to obtain a Cu—Au—Ag cement and separating the Cu—Au—Ag cement from the reagent solutions used in the process of leaching gold and silver contained in the low grade refractory ores and concentrates.

3. The method according to claim 2 further comprising the steps of:

separating copper from the Cu—Au—Ag cement by leaching it in sulphuric acid solution of 30-40%, at a solid: liquid ratio of 1:5-1:10 at a temperature of 85-95° C. and under air bubbling to form copper sulphate and a sludge containing Au and Ag; and returning the copper sulphate formed in the process of leaching the low-grade refractory ores and concentrates and recovering the sludge containing Au.

4. The method according to claim 2, further comprising the step of:

recirculating the thiosulfate reagent solution used in the process of leaching gold and silver contained in the low-grade refractory ores and concentrates back to the leaching of gold and silver.

5. The method according to claim 1 further comprising the step of:

recirculating the thiosulfate reagent solution used in the process of leaching gold and silver contained in the low-grade refractory ores and concentrates back to the leaching of gold and silver.

* * * * *